United States Patent [19]

Steinman

[11] Patent Number: 4,493,416

[45] Date of Patent: Jan. 15, 1985

[54] TAMPER PROOF REEL PACKAGE FOR A FISHING ROD

[76] Inventor: Kenneth Steinman, 1901 W. Lafayette Blvd., Detroit, Mich. 48216

[21] Appl. No.: 505,887

[22] Filed: Jun. 20, 1983

[51] Int. Cl.[3] ..... B65D 85/00

[52] U.S. Cl. ..... 206/315.11; 43/26; 150/52 R; 206/315.1; 206/806

[58] Field of Search ..... 43/25, 25.2, 26; 150/52 R; 206/315.1, 315.11, 461, 806

[56] References Cited

U.S. PATENT DOCUMENTS

| | | | |
|---|---|---|---|
| 2,149,087 | 2/1939 | Fisher | 43/26 |
| 2,532,119 | 11/1950 | Reynolds | 206/315.11 |
| 2,599,689 | 6/1952 | Brelsford | 150/52 R |
| 2,723,482 | 11/1955 | Marten | 43/26 |
| 2,869,277 | 1/1959 | Breithaupt | 43/26 |
| 3,131,069 | 4/1964 | Goller et al. | 206/461 |
| 3,191,652 | 6/1965 | Benson | 150/52 R |
| 3,972,144 | 8/1976 | Geisler | 43/26 |
| 4,359,161 | 11/1982 | Sinoff | 206/315.11 |

FOREIGN PATENT DOCUMENTS

| | | | |
|---|---|---|---|
| 0658288 | 2/1963 | Canada | 150/52 R |
| 2821318 | 12/1978 | Fed. Rep. of Germany | 206/461 |
| 1419803 | 10/1965 | France | 43/26 |
| 2029360A | 3/1980 | United Kingdom | 206/461 |
| 2059731A | 4/1981 | United Kingdom | 43/26 |

*Primary Examiner*—George E. Lowrance
*Assistant Examiner*—Jimmy G. Foster
*Attorney, Agent, or Firm*—Cullen, Sloman, Cantor, Grauer, Scott & Rutherford

[57] ABSTRACT

A tamper proof anti-theft reel package for a fishing rod having a handle and a reel mounted thereon comprises a unit molded sheet of clear plastic material having a tubular body to extend around the reel handle. A pair of opposed cup shaped reel enclosing halves extend from the body as a continuation thereof and terminate in peripheral engaging flanges which are secured together.

1 Claim, 3 Drawing Figures

TAMPER PROOF REEL PACKAGE FOR A FISHING ROD

BACKGROUND OF THE INVENTION

Heretofore in the display of fishing rods with a reel mounted thereon in stores, sport shops or hardware outlets, there has long existed the problem of people tampering with a fishing rod assembly, such as removing and taking the reel, removing and taking merely the reel handle or the reel and clip hardware. These items are constantly being removed from rods and reels and are a real problem to store managers. Eventually the item is returned to the supplier as defective.

SUMMARY OF THE INVENTION

It is an important feature of the present invention to provide a tamper proof anti-theft reel package for a fishing rod and wherein the package enclosure for the reel retainingly engages and extends around and is secured to the fishing rod handle.

A further feature is to provide a tamper proof anti-theft reel package for a fishing rod having a handle and reel mounted thereon wherein a unit molded sheet of clear plastic material is formed so as to protectively extend around portions of the fishing rod handle to protectively enclose the complete fishing reel and its handle to be securely closed so that at all times the reel as attached to the fishing rod remains as an assembled part thereof.

A further feature is to provide a reel package wherein within a unit sheet of clear plastic material, there is formed a tubular body adapted to protectively enclose and surround portions of the fishing rod handle with said body terminating in a pair of opposed non-symmetrical cup shaped reel enclosures, wherein the reel enclosures terminate in peripheral registering opposed flanges which are suitably secured together.

It is a further feature to provide a tamper proof anti-theft reel package for a fishing rod having a handle wherein a package protectively encloses and retains portions of the handle, as well as the complete reel including its handle and wherein the peripheral engaging edges of the opposed cup shaped members are peripherally sealed, stapled or otherwise secured together. So assembled, it is quite difficult to surreptitiously remove from a store the complete fishing rod with the attached reel thereon.

A further feature contemplates the use of a unit package to enclose a portion of the fishing rod handle and the reel mounted thereon and wherein the tubular portion and marginal portions of the cup shaped members terminate in opposed registering flanges arranged in engaging relation and suitably secured together providing a tight protective enclosure for the reel and adjacent portions of the rod to which it is attached.

These and other features and objects will be seen from the following Specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
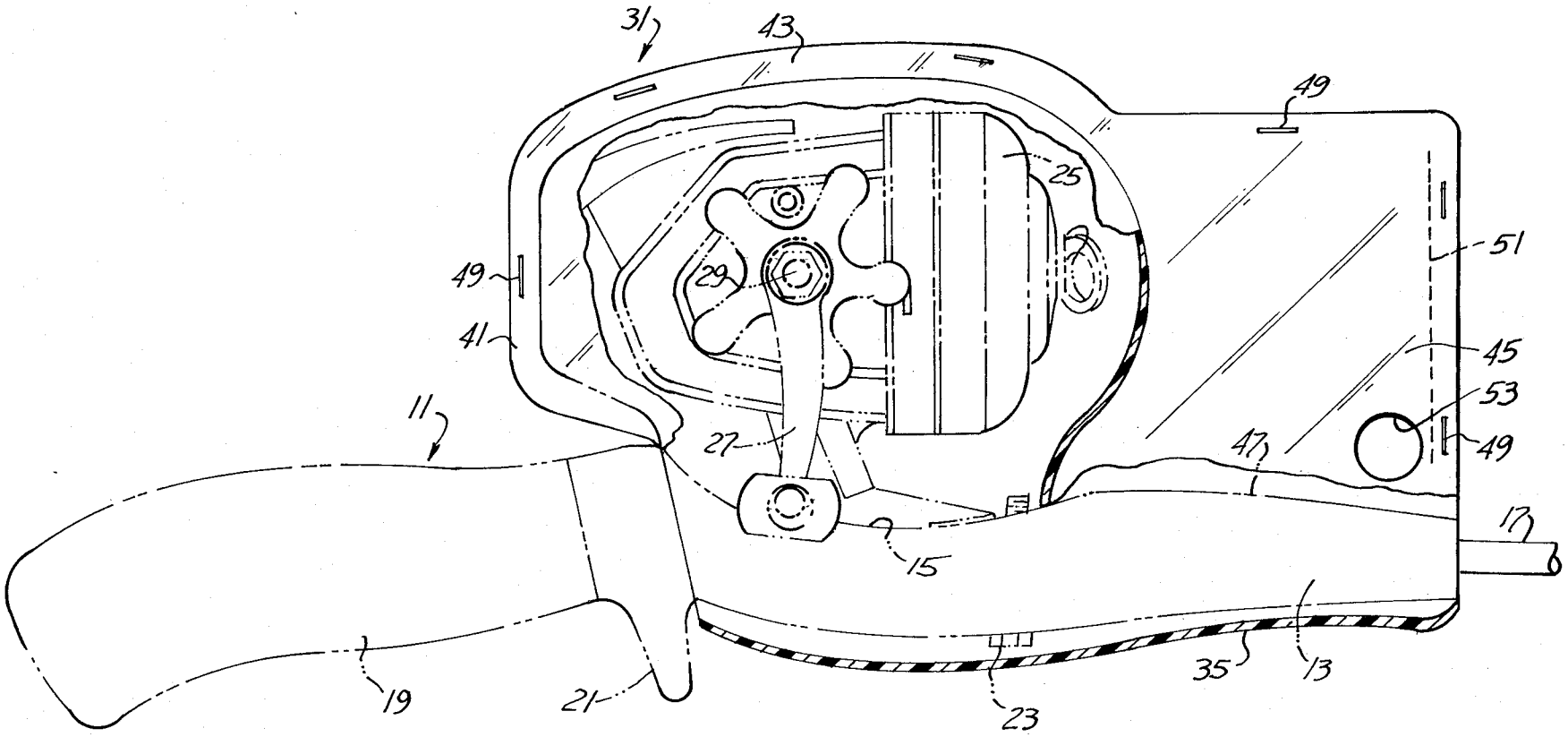
FIG. 1 is a fragmentary side elevational view of a conventional fishing rod having a handle with the present tamper proof anti-theft reel package protectively enclosing the handle and reel and secured thereto, the fishing rod being broken away. One side is partly broken away.
Figure 2:
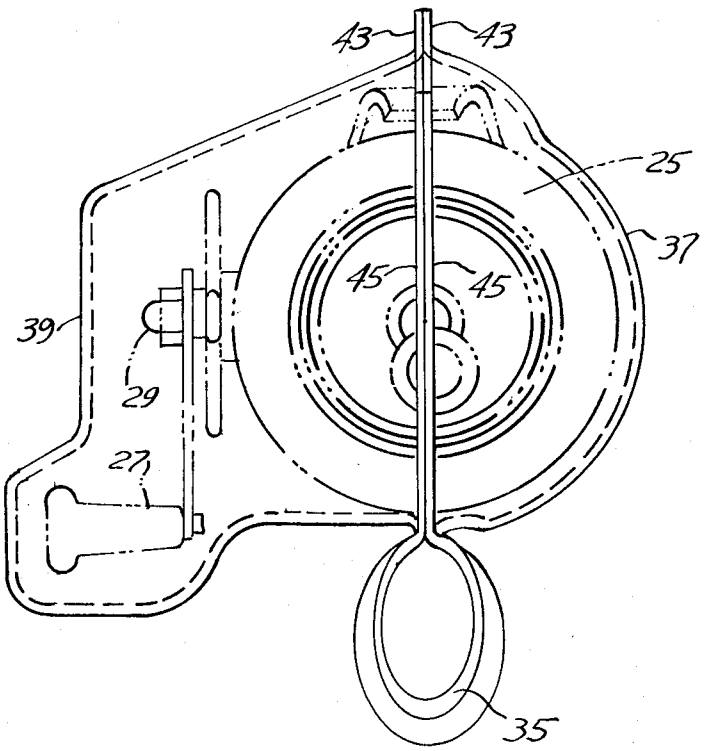
FIG. 2 is a front elevation view thereof.
Figure 3:
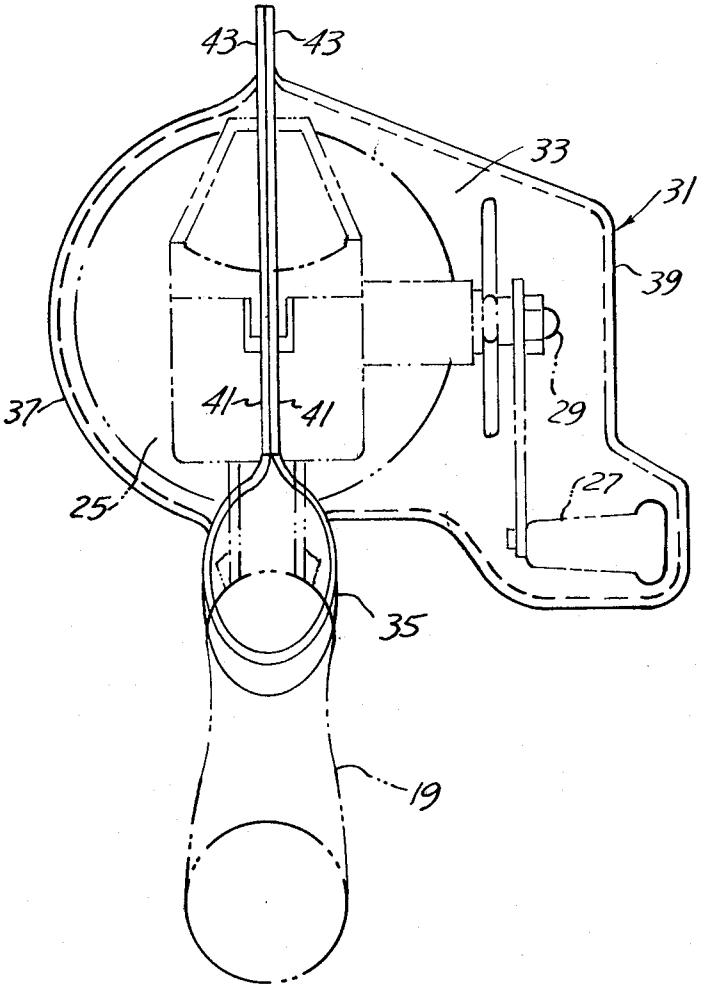
FIG. 3 is a rear elevational view thereof.

Referring to the drawings, FIGS. 1, 2 and 3, a fishing rod and reel assembly is generally indicated at 11, FIG. 1 as including a spin cast handle 3 including a formed reel seat 15 and an elongated rod 17 which in the illustrative embodiment is broken away. The opposite end of the handle 13 terminates in a formed grip 19 with the intermediate trigger 21 which is conventional in many fishing rod assemblies.

As is also conventional on such assemblies, there is shown a clip and screw assembly 23 by which fishing reel 25 is secured upon the reel seat 15 for normal use. As is conventional the reel 25 includes winder arm 27, at one end anchored axially as by fastener 29 to the rotatable portion of the reel.

It has been found in many situations that a person will come into a store and remove only the handle 27 and the fastener 29 to replace a missing handle or to provide an extra handle for the fisherman. Often times, only the fastener and clip assembly 23 is borrowed. In many cases, the reel 25 is surreptitiously removed.

The present anti-theft tamper proof reel package for fishing rods is generally designated at 31, FIG. 3 and includes a unit molded sheet of clear plastic such as P.V.C. having a thickness for illustration of 0.011 inches, though not limited thereto.

The unit sheet of plastic material is formed centrally with an elongated tubular body 35 which is adapted to surround a major portion of the handle 13 and terminates at its upper edges in a pair of integral opposed reel enclosing cup shaped halves 37 and 39, which, as shown in FIGS. 2 and 3, are non-symmetrical. The oversized reel half 39 encloses that portion of the reel body which includes the laterally extending winder arm 27 and its axial fastener 29 connected to a rotative portion of the reel.

Each of the reel halves 37 and 39 are continuations of and extend from upper portions of tubular body 35 and are adapted to protectively enclose the reel 25.

Each of the cup shaped halves 37 and 39 in the illustrative embodiment terminate in opposed engaging flat end flanges 41, opposed engaging top flanges 43 and opposed registering flanges or mount sheets 45 which are exterior to the reel and are arranged forwardly, above and rearwardly of the reel.

The opposed reel enclosing halves 37 and 39 extend from upper portions of the tubular body 35 which is adapted to enclose the handle 13, with the cup shaped halves 37 and 39 forming integral continuations thereof and terminating in the peripheral meeting flanges 41 and 43 and 45.

The registering flanges are secured together by plurality of fastening means as for example, the spaced staples 49. Sealing and securing could be achieved by an equivalent electro static seal or a heat seal such as shown at 51 or any equivalent securing such as the use of tape.

In the illustrative embodiment, the pair of opposed registering flanges 45 extend not only from the cup shaped members at the forward ends thereof, but also from upper adjacent edges of the tubular member 35 in order to form rectangular enlarged card type of flanges providing a reinforcement for the package and having registering transverse apertures 53 therein adapted for mounting the package including the rod and the reel upon a pegboard.

It is contemplated various types of rods and reels may be employed, however, the construction of the present unit plastic anti-theft and tamper proof reel package is substantially the same with variations possible only in dimensions as would be needed to protectively enclose and retain a particular fishing rod handle and the adjacent reel mounted thereon. The packaging for the reel and the associated adjacent portion of the rod handle is such that there can be no access to the reel to surreptitiously separate the reel from the rod handle, nor is there any access to any of the reel parts or to the fastening hardware for the reel. This therefore provides a long needed protective packaging for a fishing rod handle upon which a reel is mounted which protectively encloses the reel and is secured thereto and retainingly engages and surrounds adjacent portions of the fishing rod handle.

Having described my invention, reference should now be had to the following claims:

I claim:

1. A tamper proof anti-theft reel package for a fishing rod having a handle and a reel mounted thereon;

comprising a unit molded sheet of plastic material having an elongated tubular body adapted to extend around the rod handle;

a pair of opposed cup shaped reel enclosing halves extending from said tubular body as a continuation thereof, adapted to protectively enclose the reel;

each of said halves terminating in opposed engaging marginal flanges;

said marginal flanges being arranged outwardly of the front, rear and top of said cup shaped halves;

and fastening means peripherally interconnecting and securing said flanges together;

said cup shaped halves extending mid-way of the length of said body;

the opposed engaging marginal flanges upon said cap shaped halves for the reminder of the length of said body extending substantially to the top of said cup-shaped halves and forwardly thereof forming a stiffened flat mount card;

said latter flanges having registering apertures therethrough adapted to receive a pegboard;

said tubular body functioning as a hinge for enclosing said handle and upon opening of said body halves facilitating removal of the rod and reel from said package.

* * * * *